US005580239A

United States Patent [19]

Jang

[11] Patent Number: 5,580,239

[45] Date of Patent: Dec. 3, 1996

[54] MULTI-FUNCTIONAL LIGHTER

[76] Inventor: Ik-Byong Jang, Sangshin Apt. 10-101 #1000-2, Sadang 4-dong, Dongjak-Gu, Seoul, Rep. of Korea

[21] Appl. No.: 580,842

[22] Filed: Dec. 29, 1995

[30] Foreign Application Priority Data

Feb. 16, 1995 [KR] Rep. of Korea ..... 95-2463
Mar. 21, 1995 [KR] Rep. of Korea ..... 95-5892

[51] Int. Cl.[6] ..... B43K 29/00
[52] U.S. Cl. ..... 431/253; 401/195
[58] Field of Search ..... 431/253; 401/195

[56] References Cited

U.S. PATENT DOCUMENTS 3,150,507 9/1964 Smith ..... 431/253
4,348,799 5/1983 Shklovsky ..... 401/195
5,454,657 10/1995 Kim ..... 431/253

*Primary Examiner*—Carroll B. Dority
*Attorney, Agent, or Firm*—Ladas & Parry

[57] ABSTRACT

A gas lighter with a body having a first end and a second end with a conduit having a first and a second opening extending in the body with a striker wheel 2 rotatably positioned at the first end of the body proximate the first opening of the conduit is disclosed. The body further includes an elongated gas tank 5 for storing gas therein with a gas suction pipe positioned in the elongated gas tank which conveys the stored gas out of the tank. The gas suction pipe terminates in an end with a gas discharge valve and is positioned proximate the striker wheel for starting and stopping gas flow from the elongated gas tank. A flint is positioned in and extends from the first opening of the conduit and operatively engages the striker wheel. A pedal 3 juxtaposed the striker wheel is operatively connected to the gas discharge valve for opening and closing the valve, in use, such that upon simultaneously rotating the striker wheel the flint generates a spark and manipulating the pedal to open the gas valve causing release of the gas by the open gas valve to contact the spark to produce a flame. A writing pen core 6 having a ballpoint is operatively positioned in the conduit to permit the ballpoint to extend out of the second opening of the conduit to enable use of the ballpoint pen. The body further includes a straight-edge formed thereon and which extends from the first end to the second end of the body.

8 Claims, 2 Drawing Sheets

MULTI-FUNCTIONAL LIGHTER

BACKGROUND OF INVENTION

1. Field of the Invention

The present invention relates to a combination of a gas cigarette lighter, a ballpoint pen and a convenient straight-edge or ruler, and in particular to a gas cigarette lighter which functions as a ruler having a plurality of scales printed thereon, such as an inch scale and a millimeter scale, and the like, and as a ballpoint pen with the elongated gas tank forming a pen like barrel which includes a conduit secured in the center of the gas tank for receiving a ballpoint pen core and a flint therein.

2. Information Disclosure statement

Conventionally a gas cigarette lighter, a ruler and a ballpoint pen are manufactured separately and independently from each other. However, carrying these separate articles is annoying and there is an added inconvenience in that a lot of time is taken to locate the individual articles when one or all of them become lost, misplaced or are stored at different locations.

An object of the present invention is to provide a gas lighter having the functions of a ballpoint pen with a ballpoint pen core inserted at the center of the gas lighter and a straight-edge or ruler with a linear measurement scale printed or formed on the periphery of the elongated gas tank.

The preceding object should be construed as only presenting a few of the more pertinent features and applications of the invention. Many other beneficial results can be obtained by applying the disclosed invention in a different manner or modifying the invention within the scope of the disclosure. Accordingly, other objects and a fuller understanding of the invention may be had by referring to both the Summary of the Invention and the Detailed Description, below, which describe the preferred embodiment in addition to the scope of the invention defined by the claims considered in conjunction with the accompanying drawings.

SUMMARY OF THE INVENTION

Therefore, the present invention has been invented to solve the above described inconveniences.

The combination gas lighter of the present invention is defined by the claims with a specific embodiment shown in the attached drawings. For the purpose of summarizing the invention, the invention relates to a combination gas lighter which includes a body having a first end and a second end with a conduit, which is a hollow tube having a first and a second opening, extending therein. A striker wheel is positioned at the first end of the body proximate the first opening of the conduit and is rotatably supported on a shaft to permit the striker wheel to be rotated against a flint. The body further includes an elongated gas tank 5 for storing gas therein with a gas suction pipe positioned in the elongated gas tank for conveying the gas stored in the elongated gas tank and having an end terminating in a gas discharge valve. The gas discharge valve is positioned proximate the striker wheel for starting and stopping gas flow from the elongated gas tank. The flint is positioned in and extending from the first opening of the conduit and operatively engages the striker wheel. A pedal is used which is juxtaposed the striker wheel and operatively connected to the gas discharge valve for opening and closing the valve, such that in use upon simultaneously rotating the striker wheel the flint generates a spark and manipulating the pedal to open the gas valve causing release of the gas by the open gas valve to contact the spark to produce a flame. A writing pen core having a ballpoint is operatively positioned in the conduit to permit the ballpoint to extend out of the second opening of the conduit to enable use of the ballpoint pen. The body further includes a straight-edge formed thereon and extending from the first end to the second end of the body. A cap having a first and a second end with the first end being closed and the second being open to receive the second end of the body therein for covering the ballpoint when not in use. The cap further includes a straight-edge formed thereon extending from the first end to the second end of the first cap which, in use, can be aligned with the straight-edge formed on said body to enable the drawing of and testing of straight lines and surfaces.

The gas lighter of the present invention achieves the above objects by providing the functions of a ruler and a ballpoint pen and is characterized in that a fuel tank of the gas lighter is of a long and round shape in the form of a writing tool with a long conduit extending therein, preferably in the center of the fuel tank, to receive therein a ballpoint pen core, a spring and a lighter flint. At the top of the fuel tank are positioned a striker wheel, a pedal and a gas discharge valve of the type known in the art with the flint inserted into the conduit and forced against the striker wheel by the spring. The ballpoint pen core is inserted into the conduit below the spring and a ballpoint pen cone is screwed onto a thread portion of the body. A gas injection inlet is formed at one side of the body and a gas suction pipe is installed inside the fuel tank to provide a gas discharge valve for the gas to support a flame. A cap is provided for covering the ballpoint part of the body. Preferably, the cap includes a flint storing compartment for storing flints therein.

The more pertinent and important features of the present invention have been outlined above in order that the detailed description of the invention which follows will be better understood and that the present contribution to the art can be fully appreciated. Additional features of the invention described hereinafter form the subject of the claims of the invention. Those skilled in the art can appreciate that the conception and the specific embodiment disclosed herein may be readily utilized as a basis for modifying or designing other structures for carrying out the same purposes of the present invention. Further, those skilled in the art can realize that such equivalent constructions do not depart from the spirit and scope of the invention as set forth in the claims.

BRIEF DESCRIPTION OF THE DRAWINGS

For a fuller understanding of the nature and objects of the invention, reference should be had to the following detailed description taken in conjunction with the accompanying drawings in which.

Similar reference characters refer to similar parts throughout the several views of the drawings.

DETAILED DESCRIPTION OF THE INVENTION

A detailed description of the preferred embodiment is given below with reference to the accompanying drawings.

Figure 1:
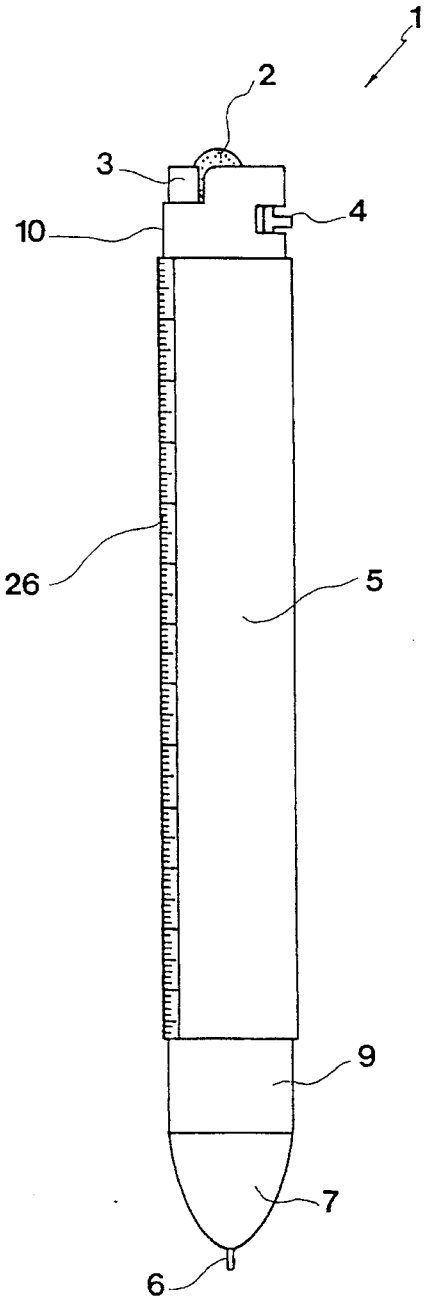
FIG. 1 is an elevational view of the gas lighter according to the present invention

FIG. 1 shows the gas lighter 1 which also functions as a ruler and a ballpoint pen according to the present invention. The gas lighter 1 comprises a body 40 with a first end 42 and a second end 44 and a conduit 18 extending therein and having a first 18A and a second 18B opening. The body further includes a straight-edge 26 formed thereon extending from the first end 42 to the second end 44 of the body 40. The striker wheel 2 is rotatably supported by a shaft and is juxtaposed the pedal 3 which is operational in an up and down position utilizes a spring which maintains the pedal in an up position, i.e. maintaining the gas discharge valve 11 in an "off" position. The flame adjusting lever 4, the gas tank 5 which is preferably round and long like a pen body and which has scales 26 formed on at least a portion of the peripheral surface thereof, the ballpoint pen core 6 positioned below the gas lighter, and a cone 7 surrounding the ballpoint pen core 6 are illustrated. The scales may be engraved in a plurality of linear units such as inch and millimeter, etc. The lower 9 and upper 10 portions of the gas tank 5 are each concentrically formed relative to the interior diameter of the cap 8 in order to receive the cap 8 thereon, as see FIG. 5.

Figure 2:
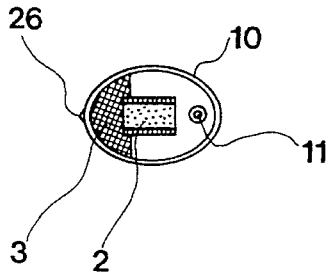
FIG. 2 is a top view of the gas lighter shown in FIG. 1.

FIG. 2 is a top view of the gas lighter 1 shown in FIG. 1 and illustrates the striker wheel 2 in the center, the pedal 3 on the left, a gas discharge valve 11 on the right, and the cap receiving part 10. The top section of the gas lighter is preferably slightly elliptic, but may be other shapes.

Figure 3:
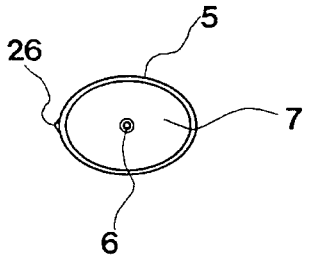
FIG. 3 is a bottom view of the gas lighter shown in FIG. 1.

FIG. 3 is a bottom view of the gas lighter 1 shown in FIG. 1 illustrating the gas tank 5, the cone 7 and the ballpoint pen core 6.

Figure 4:
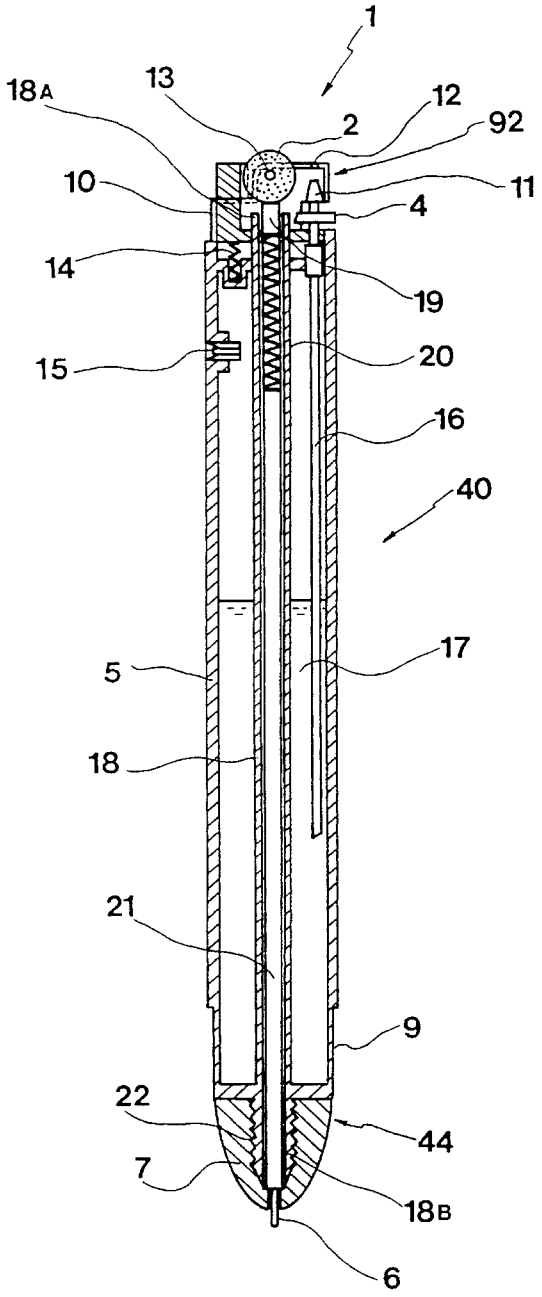
FIG. 4 is a longitudinal sectional view of the gas lighter shown in FIG. 1.

FIG. 4 is a longitudinal sectional view of the gas lighter 1 according to the present invention. At the top of the gas tank 5 are installed the striker wheel 2 rotatably supported on a shaft 13, the pedal 3 operatively connected to the gas discharge valve 11 and biased in a closed position by spring 14 and a flame hole 12. The flame adjusting lever 4 is installed at the lower end of the gas discharge valve 11 so that the size of the flame can be adjusted by the user.

The gas injection inlet 15, through which the gas can be injected is positioned at the mid portion of the gas tank 5 so that the gas tank 5 can be refilled when the gas is exhausted. A gas suction pipe 16 is secured to the gas discharge valve 11 and delivers gas stored in the gas tank to the valve 11. The gas lighter described thus far is of a type known commercially. However, the gas lighter of the present invention is constructed in such way that the conduit 18 extends from the first end 42 to the second end 44 of the body and is positioned at the center of the gas tank 5 which is round and long like a pen body. The flint 19 is installed in the first opening 18A of the conduit 18 and the bottom of the flint 19 is pressed against the striker wheel by compression spring 20. The ballpoint pen core 21 is inserted into the second opening 18B of the conduit 18 and presses against the spring 20. The ballpoint pen core 6 is held in place by cone 7 which is threaded onto the threaded portion 22 formed on the conduit proximate the second opening 18B as illustrated in FIG. 4. If the ink supply of the ballpoint pen core 21 becomes exhausted, it can be replaced by a new ballpoint pen core readily available in the market. The cap 8 concentric receiving tapered part 9 is formed on the lower part of the gas tank 5 and the concentric tapered part 10 is formed on the upper part of the gas tank 5, as illustrated in FIG. 4.

Figure 5:
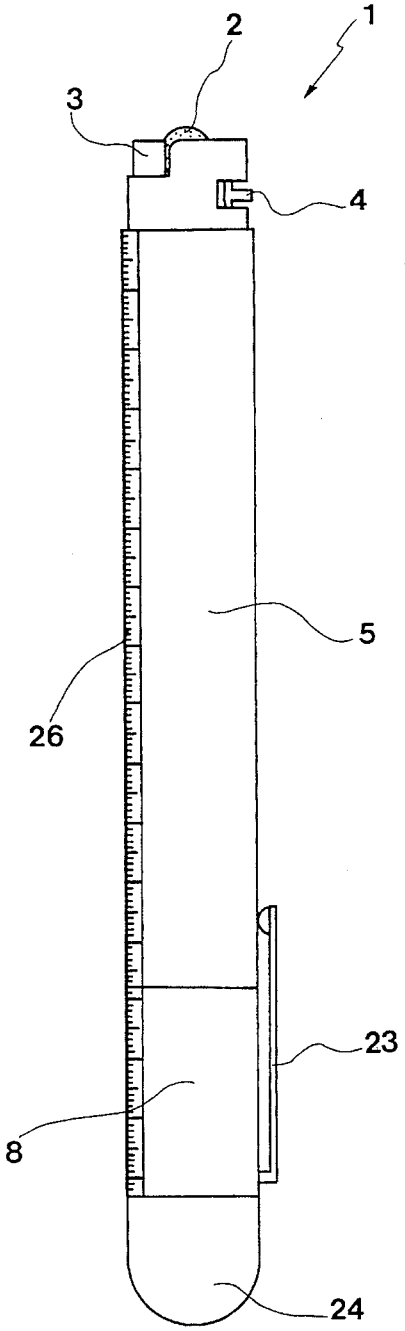
FIG. 5 shows the ballpoint pen covered with a cap according to the present invention.

FIG. 5 shows cap 8 inserted onto the gas lighter 1. When in use, the cap 8 is removed to expose the ballpoint pen and positioned on the opposite portion of the lighter. The cap 8 has a clip 23 so that the gas lighter 1 can be secured to the clothes.

Figure 6:
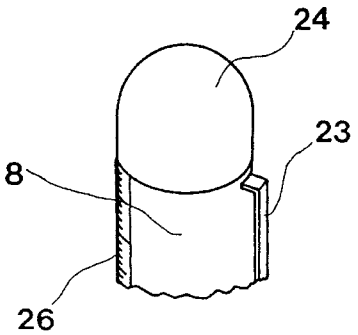
FIG. 6 shows cap 8 with a flint storing compartment 25.

FIG. 6 shows top cover 24 for accessing a flint compartment 25 on the top of the cap 8 in a closed positioned.

Figure 7:
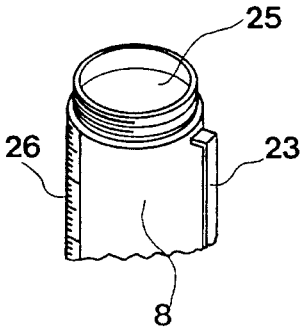
FIG. 7 shows the fling storage compartment 25 with cap 24 removed.

FIG. 7 shows the top cover 24 removed from the cap 8 shown in FIG. 6 and also shows the flint storing compartment 25 on top of the cap 8.

The gas lighter of the present invention constructed as described above may be used as a ballpoint pen by inserting a ballpoint pen core into the center of the gas tank and may be used as a portable convenient ruler optionally including a plurality of linear scales, such as millimeters, etc., engraved thereon, and that the flint can be easily replaced when it is exhausted since the flint storing compartment is provided on top of the cap.

It should be clear to those skilled in the art to which the present invention pertains that although the present invention is described with respect to the preferred embodiment, it is not limited to the preferred embodiment and alterations or modifications can be made within the scope of the present invention.

Although this invention has been described in its preferred form with a certain degree of particularity, it is appreciated by those skilled in the art that the present disclosure of the preferred form has been made only by way of example and that numerous changes in the details of the construction, combination and arrangement of parts may be resorted to without departing from the spirit and scope of the invention.

What is claimed is:

1. A combination gas lighter comprising:

a body 40 having a first end 42 and a second end 44 with a conduit 18 extending therein and having a first 18A and a second 18B opening;

a striker wheel 2 positioned at said first end of said body proximate said first opening of said conduit and being rotatably supported on a shaft;

said body further including an elongated gas tank 5 for storing gas therein;

a gas suction pipe positioned in said elongated gas tank for conveying said gas stored in said elongated gas tank and having an end terminating in a gas discharge valve positioned proximate said striker wheel for starting and stopping gas flow from said elongated gas tank;

a flint positioned in and extending from said first opening of said conduit and operatively engaging said striker wheel;

a pedal 3 juxtaposed said striker wheel and operatively connected to said gas discharge valve for opening and closing said valve, in use, such that upon simultaneously rotating said striker wheel said flint generates a spark and manipulating said pedal to open said gas valve causing release of said gas by said open gas valve to contact said spark to produce a flame; and a writing pen core 6 having a ballpoint operatively positioned in said conduit to permit said ballpoint to extend out of said second opening of said conduit to enable use of said ballpoint pen.

2. The combination gas cigarette lighter of claim 1 wherein said elongated gas tank further includes a gas injection inlet 15 through which gas can be injected into said elongated gas tank to enable said tank to be refilled when the gas is exhausted.

3. The combination gas cigarette lighter of claim 1 wherein said second end of said body terminates in a cone shape with said ballpoint extending therefrom.

4. The combination gas cigarette lighter of claim 1 wherein said body further includes a straight-edge formed thereon extending from said first end to said second end of said body.

5. The combination gas cigarette lighter of claim 4 further including a cap 8 having a first and a second end with said first end being closed and said second being open to receive said second end of said body therein for covering said ballpoint when not in use; and said cap further including a straight-edge formed thereon extending from said first end to said second end of said first cap which, in use, can be aligned with said straight-edge formed on said body to enable the drawing of and testing of straight lines and surfaces.

6. The combination gas cigarette lighter of claim 5 wherein said cap further includes a flint storing compartment 25.

7. A combination gas lighter comprising:

a body having a first end and a second end with a conduit extending therein and having a first and a second opening;

a striker wheel 2 positioned at said first end of said body proximate said first opening of said conduit and being rotatably supported on a shaft;

said body further including an elongated gas tank 5 for storing gas therein with said elongated gas tank including a gas suction pipe for conveying said stored gas from said elongated gas tank and having an end terminating in a gas discharge valve at said first end of said body for starting and stopping gas flow from said elongated gas tank;

a flint positioned in and extending from said first opening of said conduit and operatively engaging said striker wheel;

a pedal 3 juxtaposed said striker wheel and operatively connected to said gas discharge valve for opening and closing said valve, in use, such that upon simultaneously rotating said striker wheel said flint generates a spark and manipulating said pedal to open said gas valve causing release of said gas by said open gas valve to contact said spark to produce a flame;

a writing pen core 6 having a ballpoint operatively positioned in said conduit to permit said ballpoint to extend out of said second opening of said conduit to enable use of said ballpoint pen;

said second end of said body terminating in a cone shape with said ballpoint extending therefrom;

said body further includes a straight-edge formed thereon extending from said first end to said second end of said body;

a cap 8 having a first and a second end with said first end being closed and said second being open to receive said second end of said body, including said cone, therein for covering said cone and ballpoint when not in use; and said cap 8 further including a straight-edge formed thereon extending from said first end to said second end of said first cap which, in use, can be aligned with said straight-edge formed on said body to enable the drawing of and testing of straight lines and surfaces.

8. The combination gas cigarette lighter of claim 7 wherein said cap further includes a flint storing compartment 25.

* * * * *